US006433684B1

(12) United States Patent
Lie

(10) Patent No.: US 6,433,684 B1
(45) Date of Patent: Aug. 13, 2002

(54) DEVICE FOR DETECTING AND SIGNALLING OR INDICATING STATUS AS REGARDS CONTENTS IN A CONTAINER, AND IN PARTICULAR A LETTERBOX

(75) Inventor: Bjørn Lie, Fredrikstad (NO)

(73) Assignee: Euro-Tech AS, Fredrikstad (NO)

( * ) Notice: Subject to any disclaimer, the term of this patent is extended or adjusted under 35 U.S.C. 154(b) by 0 days.

(21) Appl. No.: 09/747,711

(22) Filed: Dec. 21, 2000

(30) Foreign Application Priority Data

Dec. 30, 1999 (NO) ..... 19996567

(51) Int. Cl.[7] ..... G08B 13/14

(52) U.S. Cl. ..... 340/569; 340/545.6; 340/555; 340/556

(58) Field of Search ..... 340/569, 815.4, 340/815.45, 815.46, 815.49, 815.5, 815.52, 815.79, 500, 524, 545.3, 545.6, 555, 556, 557

(56) References Cited

U.S. PATENT DOCUMENTS 3,611,333 A * 10/1971 Conigliaro ..... 340/539
4,520,350 A * 5/1985 Huang ..... 340/569
4,633,236 A * 12/1986 Buhl ..... 340/569
4,868,543 A * 9/1989 Binkley ..... 340/569
5,060,854 A * 10/1991 Armstrong ..... 232/37
5,239,305 A * 8/1993 Murphy et al. ..... 340/539
5,247,282 A * 9/1993 Marshall ..... 340/569
5,440,294 A * 8/1995 Mercier et al. ..... 340/569
5,950,919 A * 9/1999 Adams ..... 232/34
6,046,675 A * 4/2000 Hanna ..... 340/569
6,114,959 A * 9/2000 Bennett ..... 340/569
6,222,451 B1 * 4/2001 Leow ..... 340/569
6,275,154 B1 * 8/2001 Bennett et al. ..... 340/569

* cited by examiner

*Primary Examiner*—Daniel J. Wu
*Assistant Examiner*—Toan Pham
(74) *Attorney, Agent, or Firm*—Rodman & Rodman

(57) ABSTRACT

A device for detecting and signalling or indicating status as regards contents in a container, and in particular a letterbox, comprising a detector for registering a change of state in the letterbox, which registration is transmitted to and activates a preferably remote display or the like in order to produce on the display a visual and/or audible message which signals that contents have been deposited in said letterbox. The detector is arranged in a preferably integrated mounting unit made in the form of an approximately U-shaped holder that accommodates a circuit board containing electronic components, a light transmitter, a light receiver, and wires and power supply, which unit is placed on the bottom of a container, preferably a letterbox, in such manner that the two upright legs of said holder rest against respective opposite walls of said letterbox. A detector and transmitter unit and a receiver-display unit are also described.

17 Claims, 7 Drawing Sheets

DEVICE FOR DETECTING AND SIGNALLING OR INDICATING STATUS AS REGARDS CONTENTS IN A CONTAINER, AND IN PARTICULAR A LETTERBOX

TECHNICAL FIELD

This invention relates to a device for detecting and signalling or indicating status as regards contents in a container, and in particular a letterbox. It also relates to a detector-transmitter unit and a receiver-display unit.

BACKGROUND ART

A number of devices for detecting and signalling the deposit of mail in a letterbox are known. Common to many of these is that the signalling takes place through the use of visual means arranged on the letterbox, for example, a marker flag or the lighting up of a light source. This means to say that there must be free line of sight from the observer to the letterbox. In blocks of flats where all letterboxes are assembled by the entrance door or, for example, in residential areas where letterboxes are mounted on common stands, this kind of visual signalling to an observer who is not in the immediate vicinity is, as a rule, impossible. In such cases it has therefore been proposed that the signalling should be done via cable networks.

SE Patent 504 819 teaches a letterbox of the type mentioned above which includes detecting or sensing means and indicating means for detecting and signalling the presence of an object in the letterbox. In one embodiment of the letterbox (FIGS. 2 and 3), the detecting means is a light source which directs light towards a photocell that is arranged to control a change-over switch in response to the light beam being broken as a result of the deposit of mail in the letterbox. Although the Swedish device is equipped primarily with a visual indicator on the letterbox itself, it is disclosed that a cable may be used to allow greater freedom in the positioning of the indicator, which, moreover, is also disclosed as being acoustic or of another well-known and conventional type. The SE letterbox has several movable flaps equipped with spring devices and other parts necessary to achieve its purpose. Therefore, it is relatively complicated and costly to manufacture, and to the best of the applicant's knowledge, it has not been a success. GB 2 078 107 describes a letterbox equipped with a device for signalling the deposit of mail in the letterbox. The device includes, inter alia, a switch arrangement in connection with a flap in the mail insertion slot, and it requires cable transmission to the location at which the mail received signal is given. This system as a whole is thus complicated and calls for a relatively large investment. DE 2 708 286 teaches a letterbox that has a device for detecting and signalling the deposit of contents in the letterbox. When mail is inserted, it is detected by a sensor that activates a remote receiver which is connected to the sensor and which gives visual and/or audible information. This system is especially designed for letterboxes in blocks of flats where, as a rule, these are placed together at the entrance. The document describes a number of alternative sensor embodiments, including the use of a light source where the light from a light-emitting diode falls on a light-sensitive element such as a light-dependent resistor, a photodiode or a phototransistor. Mail deposited in the letterbox breaks the light beams so that the resistance of the light-sensitive element is altered and a signal indicating the deposit of mail is produced. This signal must be relayed to a receiver which, for example, can be installed in the flat, office, etc. belonging to the letterbox owner. It is presumed that this signal transmission will take place via a permanently installed cable network. As an option, it is disclosed that the sensor can be connected to the receiver via a separate electric cable. It is also indicated that such cables should preferably be installed during the construction of the building as later installation would involve considerable costs. However, there is also a discussion of ways of connecting the signal via already existing cable networks such as the doorbell cable network. The signalling then takes place with the use of alternating current or special audible ringing signals are employed. The DE document gives no specific indication of how the device should be made and installed in the letterbox. It seems clear that the DE system will be costly and complicated, and will probably only be justifiable in fairly large communal installations. DE 1 954 531 A1 describes a similar system as that described above, but in this case the main idea is to use the entry phone system for the signalling. Lastly, EP 0 782 117 A1 describes a wireless network for controlling various household units. This network can probably be modified to also monitor letterboxes or the like, but there are no indications of such modifications.

SUMMARY OF THE INVENTION

As mentioned, the object of the present invention is to provide a device for detecting and signalling or indicating status as regards contents in a container, and in particular a letterbox, which eliminates the problems of the known devices. It is simple and inexpensive to manufacture, can be easily installed in existing letterboxes or made an integral part of new ones, and requires no cable connection between the detector and signal unit.

This object is achieved with a device for detecting and signalling or indicating status as regards contents in a container, and in particular a letterbox, comprising a detector for registering a change of state in the letterbox, which registration is transmitted to and activates a preferably remote display or the like in order to produce on the display a visual and/or audible message which signals that contents have been deposited in the letterbox, wherein the detector is arranged in a preferably integrated mounting unit made in the form of an approximately U-shaped holder that accommodates a circuit board containing electronic components, a light transmitter, a light receiver, and wires and power supply, which unit is placed on or at the bottom of a container, preferably a letterbox, in such manner that said two upright legs of said holder rest against respective opposite walls of said letterbox, and where light from said transmitter is transmitted through the inner space of said letterbox to said light receiver.

There are preferably provided guide strips on said wall to facilitate the positioning of said unit, and the legs of said holder are preferably elastic to ensure that said unit is held securely in place, and where there may also be provided holes in said holder to enable it be secured to said letterbox by means of suitable fasteners such as screws. The holder may form an integral part of the walls of said letterbox and is made of an appropriate plastic material or another suitable material and is shaped so as to be hollow. One of said upright legs may accommodate a circuit board containing said components, and said light receiver, and said light transmitter may be housed in the other upright leg. Both said light transmitter and said light receiver may however be housed in the same leg and a reflector is placed on the opposite leg. The upper end region of one or both legs is preferably shaped with a bevel edge.

There may be arranged a cover in the bottom of said holder, detachably fastened to said holder, preferably by snap fastening to the bottom edge portions of said holder, and which together with said holder forms a compartment for wires, and there may also be arranged drainage holes in the bottom of the letterbox. The transverse portion of the holder may be made so as to be telescopic.

The invention also comprise a detector-transmitter unit for use in a device for detecting and signalling or indicating status as regards contents in a container, and in particular a letterbox, comprising a detector for registering a change of state in said letterbox. The registration is transmitted to and activates a preferably remote display or the like in order to produce on said display a visual and/or audible message which signals that contents have been deposited in said letterbox. The detector comprises a light emitting diode and a photodiode, or optionally an electronic sensor (inductive/capacitive), an ultrasonic sensor, a mechanical or electromagnetic switch means etc., wherein there is provided an oscillator, a timer to control the timing and a power source, an amplifier, a multivibrator or flip-flop having a first input and a second input and a code circuit having address code inputs and a preferably high-frequency transmitter module. Said timer activates and pulses said detector transmitter component for about 20 milliseconds with a period of about 40 seconds, and if said letterbox or container is empty, said detector receiver component receives pulses from said transmitter component and the response thereto is relayed in the form of electrical signals to said amplifier; and if contents are introduced into said letterbox, the connection between said transmitter component and said receiver component is broken with the result that said amplifier is without a signal. The output from the amplifier is connected to said second input on the multivibrator whose first input is connected to said timer causes said multivibrator to be synchronised at the end of the activation time of said transmitter component, and the logical state of said flip-flop thus becomes a signal which indicates whether there are contents in said letterbox or not, the activation time and the period being implemented by a circuit with the oscillator at fixed frequency and counter elements which, depending on the number of elements and their connection, indicate the time intervals, and where the voltage from said oscillator is preferably used to operate the power source of said transmitter component, and the information from said flip-flop is passed to said code circuit which codes this information together with an address signal in the form of a serial telegram that controls said high-frequency transmitter which transmits the address and data or information telegram immediately after the activation time for said transmitter component when the contents of said letterbox has been detected.

Further, the invention comprise a receiver-display unit for use in a device for detecting and signalling or indicating status as regards contents in a container, and in particular a letterbox, comprising a detector for registering a change of state in said letterbox, which registration is transmitted to and activates a preferably remote display or the like in order to produce on said display a visual and/or audible message which signals that contents have been deposited in said letterbox, which detector comprises a light-emitting diode and a photodiode, or optionally an electronic sensor (inductive/capacitive), an ultrasonic sensor, a mechanical or electromagnetic switch means etc. Said receiver and display unit comprises a preferably high-frequency receiver, a decoder, a monostable multivibrator or flip-flop and a display, where said display comprises a visual and/or audible signal means, and where said telegram on reaching said receiver is passed to said decoder that ascertains whether said telegram contains a valid receiver address and determines the logical state of the data or information; if the information indicates that there are contents in said letterbox, an appropriate signalling means on said display is activated.

Advantageous embodiments of the invention are disclosed in the dependent patent claims.

The foregoing and other objects, features and advantages of the present invention will become more apparent in light of the following detailed description of exemplary embodiments thereof.

BEST MODE FOR CARRYING OUT THE INVENTION

Figures 1, 1A:
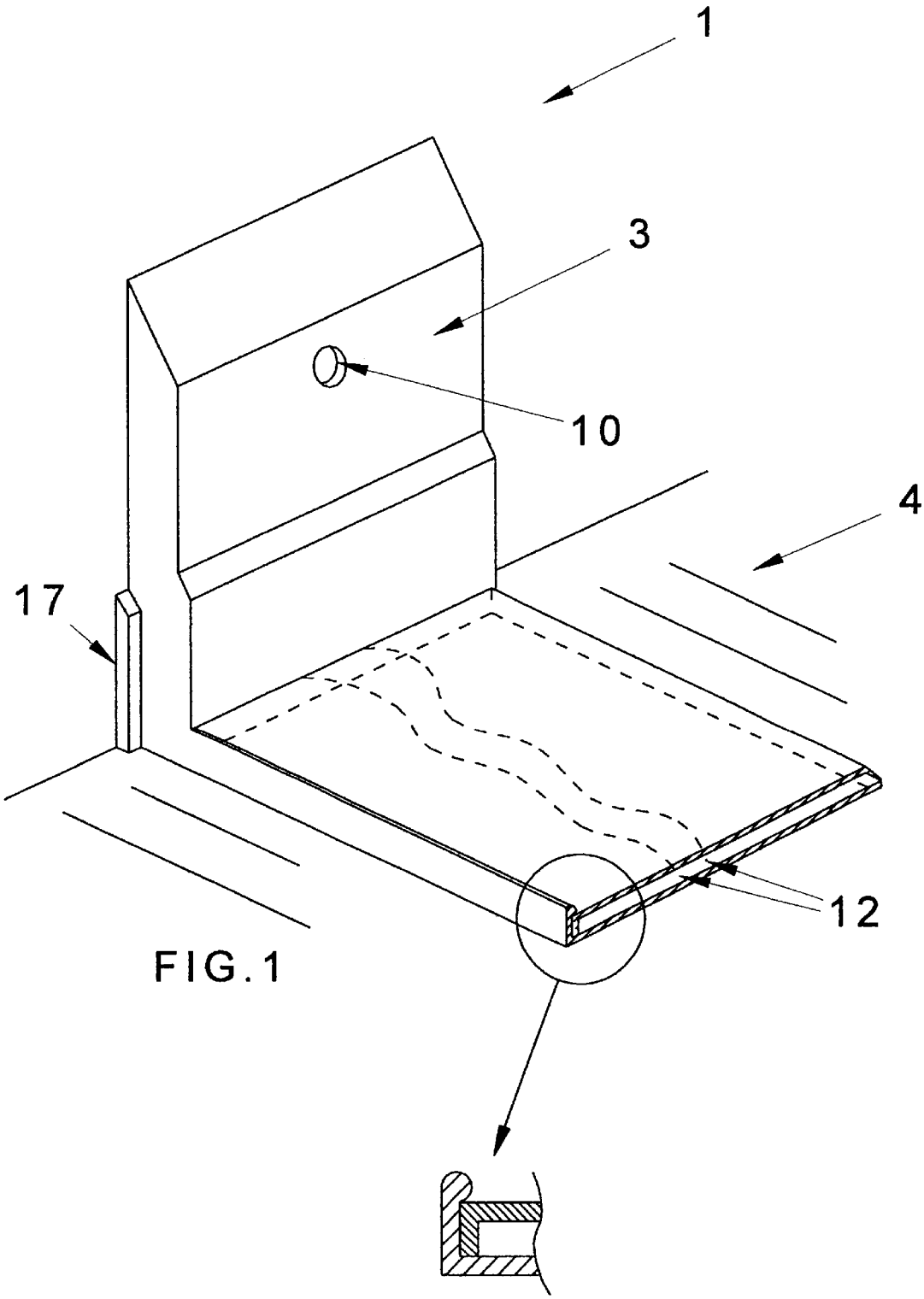
FIG. 1 is a perspective and partial sectional view of a mounting unit for the device according to the invention.
FIG. 1*a* shows a detail of the unit in FIG. 1.

A mounting unit 1 according to the invention comprises an approximately U-shaped holder 3 for a printed circuit board 6 containing electronic components 16, a light transmitter 7, a light receiver 8, wires 12 and power supply 11. The unit 1 is by way of example placed on the bottom 4 of a container, preferably a letterbox 2, in such a way that the two upright legs of the holder 3 rest against a front 5 and a back wall 5 of the letterbox. Guide strips 17 may be provided to facilitate the positioning of the unit 1. The holder legs are preferably elastic so as to ensure that the unit is held securely in place. Suitable holes may also be provided in the holder 3 to enable it to be secured to the letterbox by means of suitable fasteners such as screws (not shown).

The holder 3 may optionally be made as an integral part of the letterbox 2 where the aforementioned legs form a part of the walls 5.

The letterbox itself may be a regular metal or plastic letterbox in which the unit 1 is installed. However, it may be specially made for the device according to the invention, the unit then being included as a suitably integrated part of the letterbox. A drainage hole 14 is preferably provided in the bottom of the letterbox.

Figure 2:
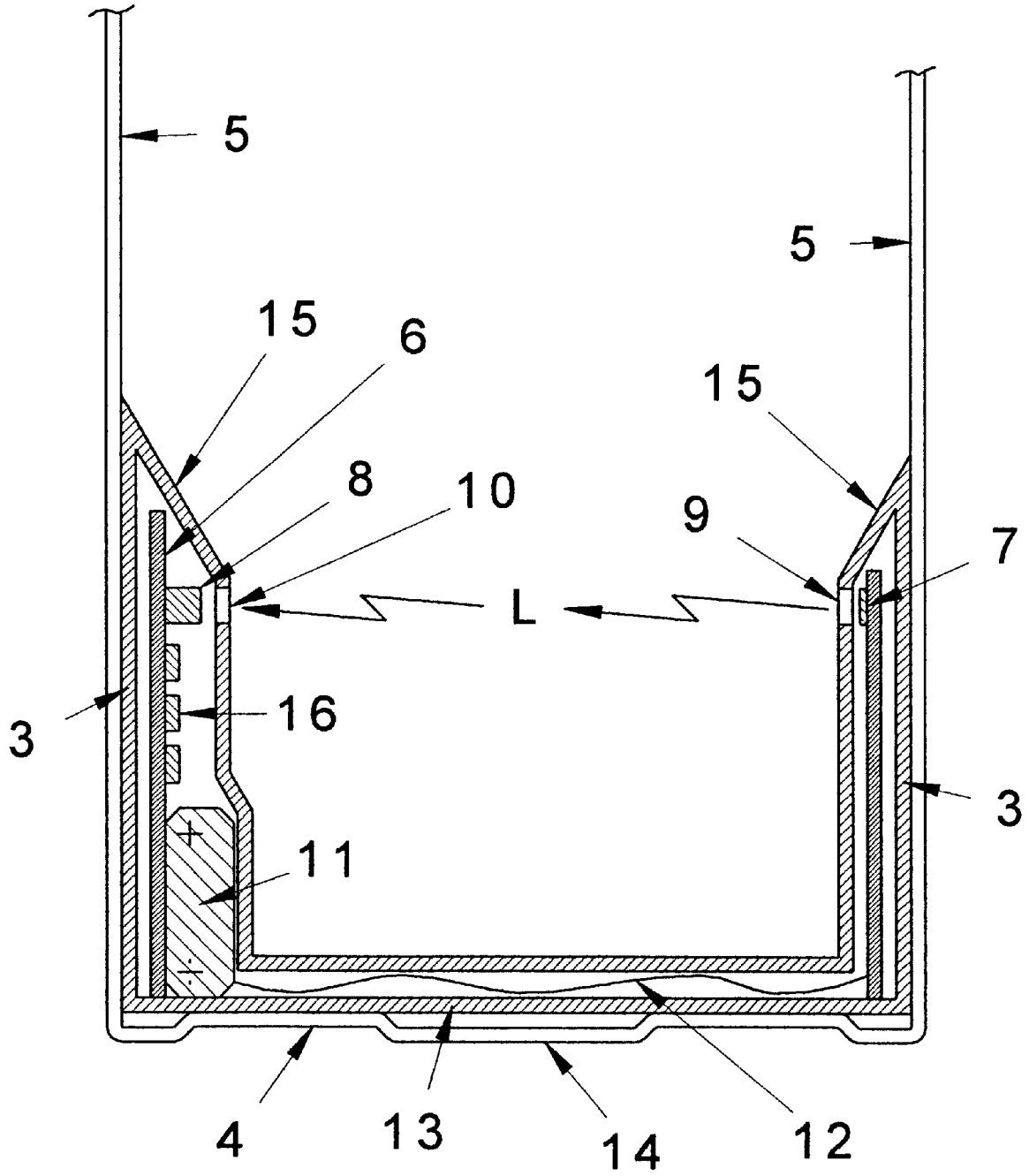
FIG. 2 is a sectional view through a container or letterbox with the mounting unit, also in section, in place.
Figure 3:
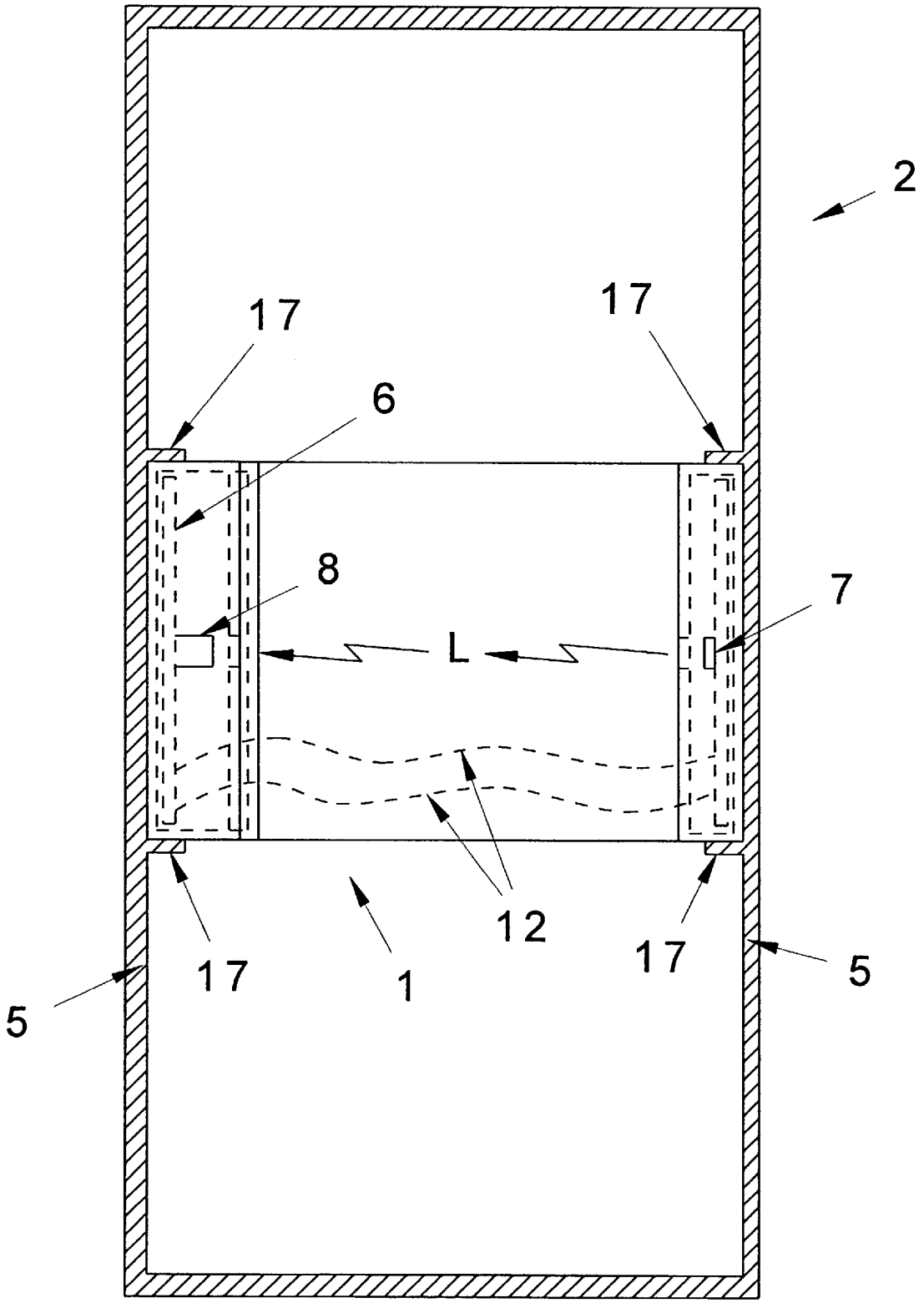
FIG. 3 is a top view of the container or letterbox, with the mounting unit, in partial section, in place.
Figure 6:
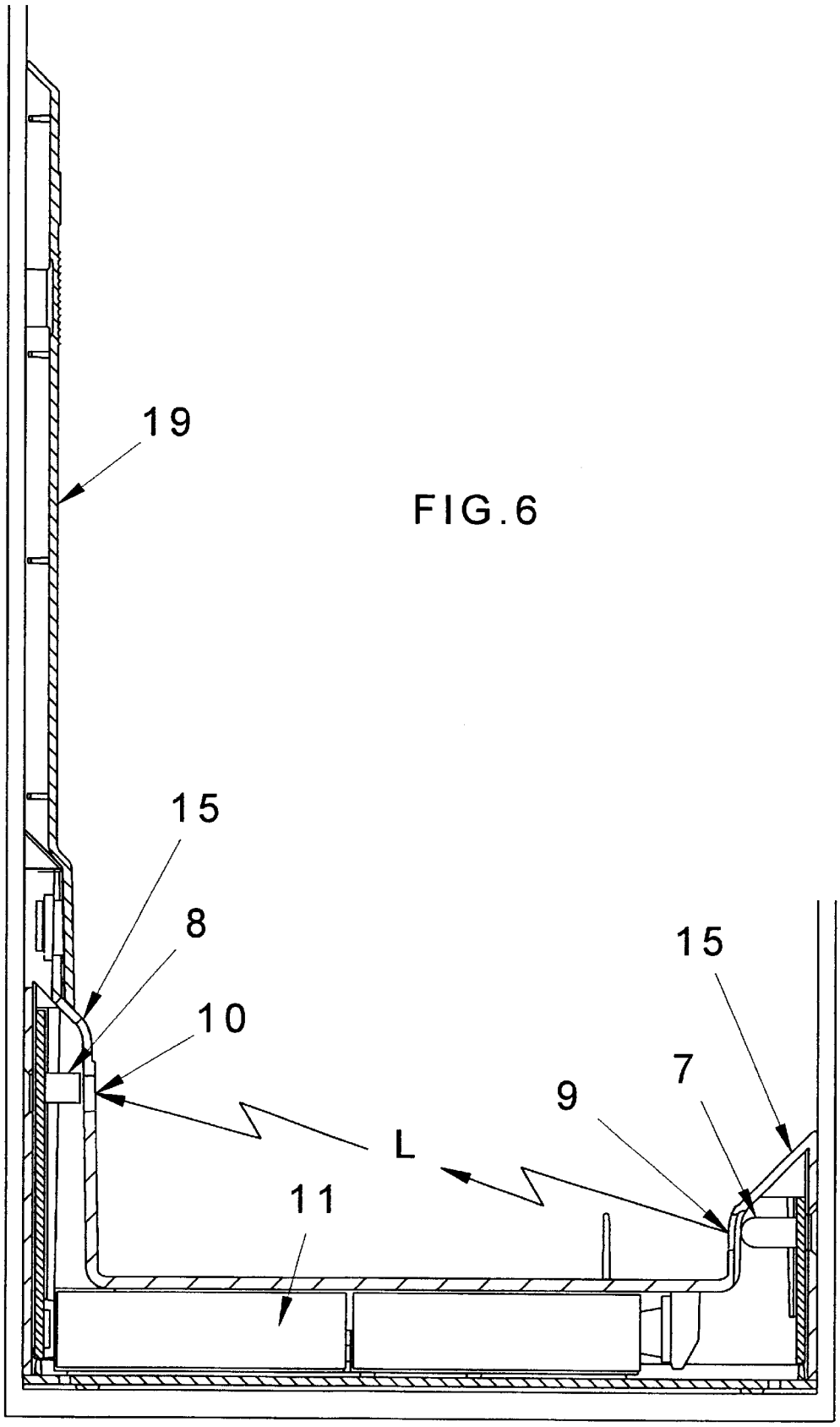
FIG. 6 shows an advantageous embodiment of the mounting unit illustrated in FIG. 2.

The holder 3 is made of an appropriate plastic material or another suitable material. It is shaped so as to be hollow, thereby permitting one of the upright legs to accommodate the printed circuit board 6 containing the components 16, and the light receiver 8. In connection with this leg, there may also be allocated space for the power supply 11, e.g., in the form of a battery. Alternatively, the power supply may be located in the transverse portion of the U shape as indicated in FIG. 6. However, it is also possible to provide power supply from a non-illustrated solar panel located, for example, on the letterbox lid. The other upright leg of the holder 3 houses the light transmitter 7. The upper regions of both legs are preferably made having a bevel edge 15 to ensure that the mail or the object deposited in the letterbox will fall to the bottom thereof In the opposite interior walls of the holder 3 there are provided aligned openings in the form of a transmitter aperture 9 and a receiver aperture 10 so as to allow light from the transmitter 7 to be transmitted through the letterbox to the light receiver 8 as indicated by the letter L in FIGS. 2 and 3. Suitable lenses or transparent protective devices may be placed in the aperture 9 and/or 10. In the bottom of the holder 3 there is preferably provided a cover 13 that is detachably fastened to the holder 3, preferably by snap fastening to the bottom edge portions of the holder 3 as indicated in FIG. 1*a*, and which together with the holder 3 forms a compartment for the wires 12.

Figure 5:
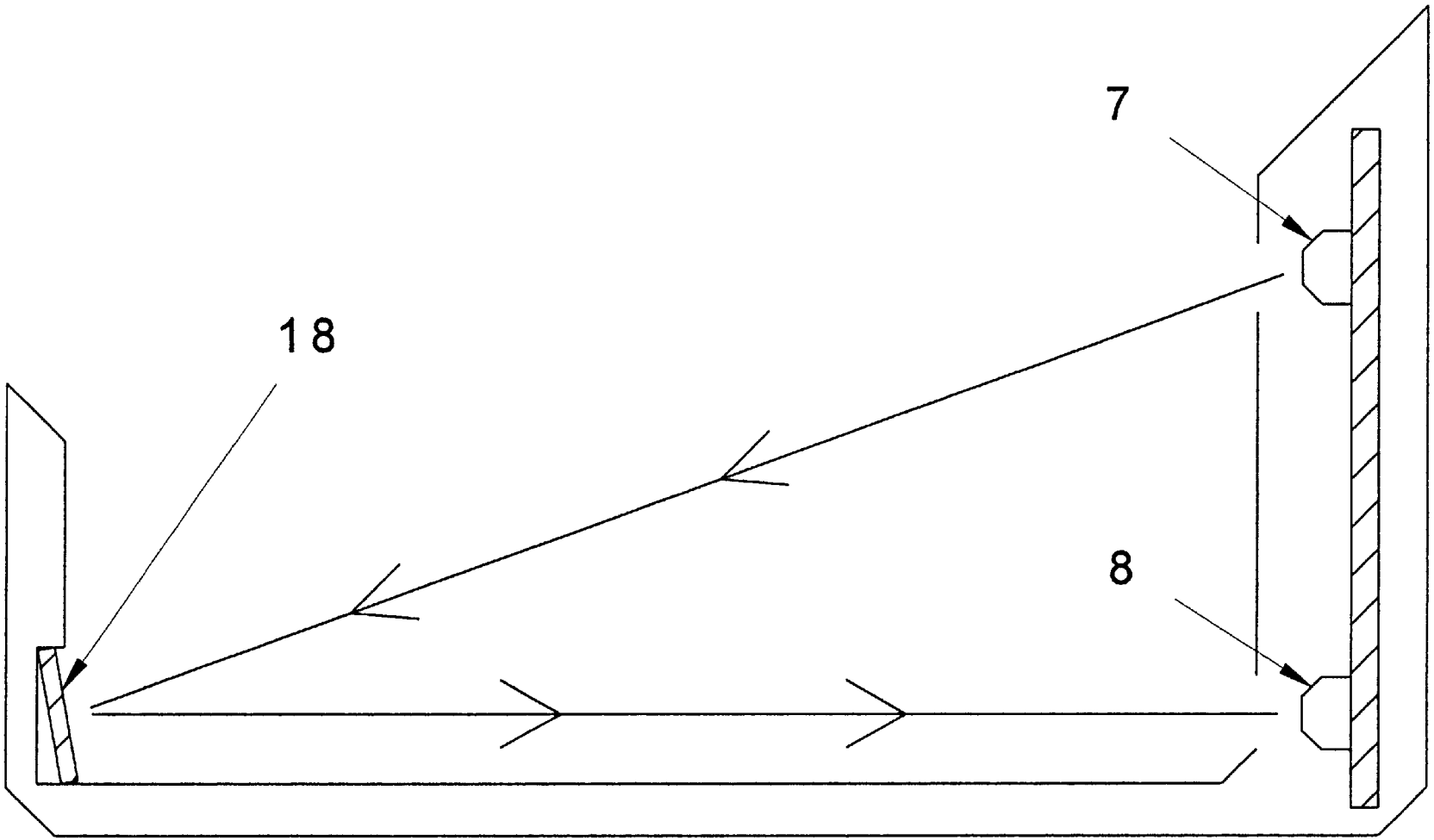
FIG. 5 is a schematic view of a variant of the mounting unit.

FIG. 5 shows an alternative embodiment where both the light transmitter 7 and the receiver 8 are housed in the same leg, and a reflector 18 is provided in the opposite leg. In the event that the holder 3 is approximately L-shaped, the reflector 18 can be arranged directly on the letterbox wall or in connection therewith. The reflector 18 may be a suitable mirror face, possibly made of metal, glass, plastic or the like. The light beam is transmitted as indicated in the figure, and is broken when contents are deposited in the letterbox.

Figure 7:
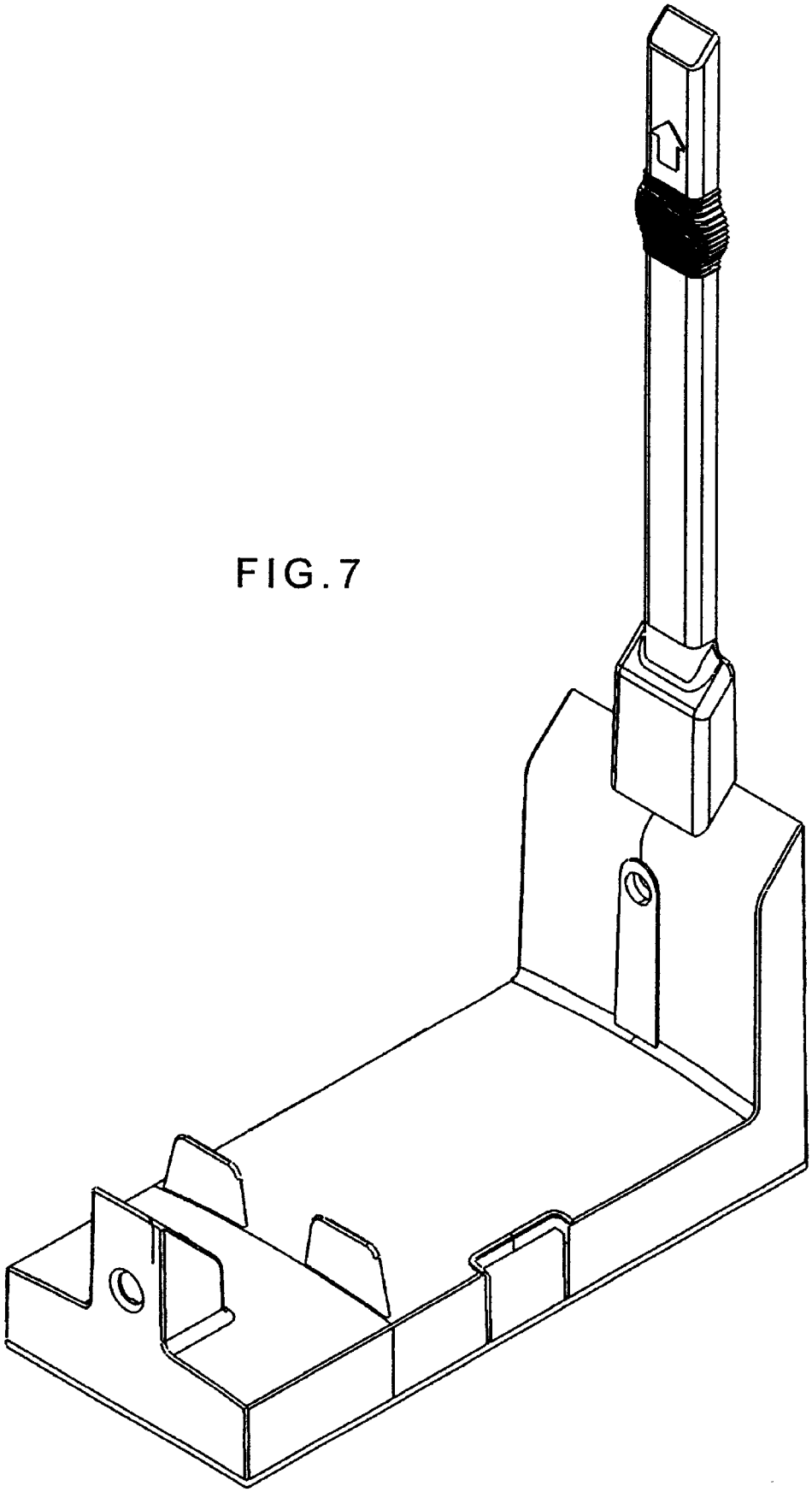
FIG. 7 is a perspective view of the unit in FIG. 6.

FIGS. 6 and 7 show yet another configuration of the device. In contrast to the device in FIG. 2, the legs are made having different lengths and the light transmitter 7 and the receiver 8 are vertically offset. A special feature of this embodiment is also that an aerial (not shown) can be arranged inside an aerial cover 19. The aerial may be connected to a printed circuit board.

If the holder 3 is made as a part intended for installation in letterboxes of different sizes, it may be advantageous to make the bottom portion of the holder 3 telescopic, so that it can be adjusted to the desired width, and, if desired, fixed in the letterbox 2. This may be particularly relevant when retrofitting the system in letterboxes already in position.

The light transmitter 7 and the light receiver 8 can be any components suitable for the purpose. However, the inventor has found that an infrared light transmitter and light receiver in the form of an IR diode and an IR phototransistor are particularly suitable, and in the description of the mode of operation of the device according to the invention components of this kind are used.

Figure 4A:
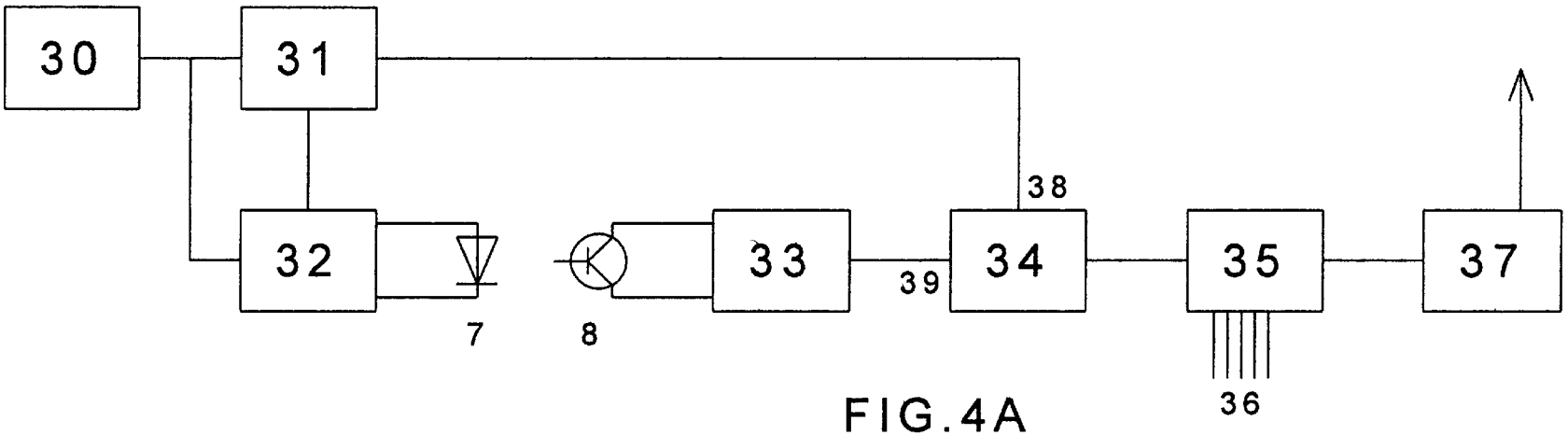
FIGS. 4*a* and 4*b* are block diagrams of the detector-transmitter unit and the receiver-display unit according to the invention.
Figure 4B:
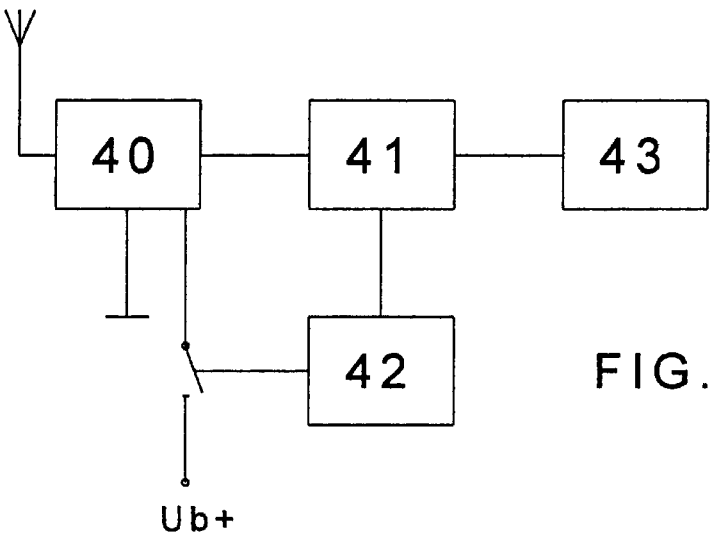

Reference will now be made to FIGS. 4*a* and 4*b* which give a schematic presentation of the detector-transmitter unit and the receiver-display unit according to the invention.

In FIG. 4*a* the reference numeral 30 indicates an oscillator. A timer for controlling the timing is indicated by means of the reference numeral 31, and a power source is indicated by the reference numeral 32. An IR diode and an IR phototransistor are indicated by means of the reference numerals 7 and 8 respectively. An amplifier 33 and a multivibrator or flip-flop 34 having two inputs 38 and 39 are also provided. In addition, there is a code circuit 35, having address code inputs 36. The final block is preferably a high-frequency transmitter module 37. The blocks or elements included in FIG. 4*a* thus correspond essentially to the components that are arranged in the holder 3. The aerial of the transmitter module can be provided on the printed circuit board 6, the letterbox 2 itself may constitute a part of the aerial, or it may consist of a suitable arrangement on or in connection with the letterbox 2.

The receiver-display unit in FIG. 4*b* comprises a preferably high-frequency receiver 40, a decoder 41, a monostable multivibrator or flip-flop 42 and a display 43. The display comprises a visual and/or audible signal device. The power supply is marked with Ub+. The unit may be given any suitable structural design and therefore is not shown. For example, it may be a separate unit or it may be combined or integrated with other alarm equipment/panels. It may also be equipped so as to be capable of transferring the signal via a telephone/data network (GSM and the like), the Internet etc.

The timer 31 activates the IR diode 7 for about 20 milliseconds with a period of about 40 seconds. As the activation time is short compared to the period, and also since the IR diode is pulsed, there is little power consumption. The phototransistor 8 is, as described, placed at a certain distance from the diode 7, and is illuminated thereby. If the letterbox or container 2 is empty, the transistor 8 receives the IR pulses from the light transmitter diode 7 and the response to these is relayed in the form of electrical signals to the amplifier 33. If contents are introduced into the letterbox 2, the photoconnection between the diode 7 and the transistor 8 will be broken and the amplifier 33 will be without a signal. The output from the amplifier 33 is connected to the input 39 of the multivibrator 34. The input 38 of the multivibrator 34 is connected to the timer 31. The flip-flop or multivibrator 34 is synchronised at the end of the activation time of the IR diode 7 and the logical state of the flip-flop 34 thus becomes a signal that indicates whether there are contents in the letterbox 2 or not. The activation time and the period are implemented by a circuit with the oscillator 30 at fixed frequency and counter elements which, depending on the number of elements and their connection, indicate the time intervals. The voltage from this oscillator 30 is preferably used to operate the power source 32 of the light transmitting diode 7.

The information from the flip-flop 34 is passed to the code circuit 35 which codes this information together with an address signal 36 in the form of a serial telegram. This telegram controls the high-frequency transmitter 37 which sends the address and data or information telegram immediately after the activation time of the IR diode 7 when the contents of the letterbox 2 has been detected.

On the receiver side 40, the incoming telegram is passed to the decoder circuit 41 which ascertains that the telegram contains a valid receiver address and determines the logical state of the data or contents information. If this information shows that the letterbox 2 has some contents, an appropriate signalling means on the display 43 will be activated. A preferred activating means is a light diode that lights up for 100 milliseconds with a period of 2 seconds. Thus, the power supply for the receiver-display unit can also be provided by a battery, because there is only power consumption of any significance when the diode lights up. Moreover, the high-frequency receiver 40 is controlled by the monostable multivibrator or flip-flop 42 which is triggered by the decoder circuit 41.

The following logic is used: the transmitter 37 sends a telegram during the period. If the monostable flip-flop 42 on the receiver side activates the high-frequency receiver 40 some seconds before the period on the transmitter side begins, the receiver 40 will always be active when the next telegram arrives. The rest of the time, the receiver 40 is inactive and thus consumes no power. In this way the useful life of the battery can be lengthened considerably. The synchronisation of the period in the transmitter 37 and the monostable flip-flop 42 is implemented by the flip-flop 42 being triggered by a valid telegram. In order to further reduce the power consumption in the receiver, the light diode can be replaced by an electronic display (LC display) in order to visualize the information.

In the above, the invention has been described in the form of a non-limiting example, and thus it is possible to make modifications without departing from the scope of the invention as defined in the patent claims below.

For example, the described device for detecting the contents of the letterbox could be replaced by a suitable electronic sensor (inductive/capacitive), an ultrasonic sensor, a mechanical or electromechanical switch means etc. Optionally, the person who deposits the object in the letterbox could press a signal button that triggers the detection and transmission or signalling. There may also be provided additional warning or signalling devices in addition to the mail received signalling, e.g., to warn that there are people in the vicinity of the letterbox.

What is claimed is:

1. A device for detecting and signalling or indicating status as regards contents in a container, and in particular a letterbox, comprising a detector for registering a change of state in the letterbox, which registration is transmitted to and activates a remote display in order to produce on the display a visual and/or audible message which signals that contents have been deposited in the letterbox, wherein the detector is arranged in an integrated mounting unit made in the form of a U-shaped holder that accommodates a circuit board containing electronic components, a light transmitter, a light receiver, and wires and a power supply which unit is placed on or at the bottom of a container, a letterbox, in such a manner that said two upright legs of said holder rest against respective opposite walls of said letterbox, and where light from said transmitter is transmitted through the inner space of said letterbox to said light receiver.

2. A device according to claim 1, wherein there are provided guide strips on said wall to facilitate the positioning of said unit, and the legs of said holder are elastic to ensure that said unit is held securely in place, and where there may also be provided holes in said holder to enable it be secured to said letterbox by means of fasteners.

3. A device according to claim 1, wherein said holder is made so as to form an integral part of the walls of said letterbox.

4. A device according to claim 1, wherein said holder is made of an appropriate plastic material or another suitable material and is shaped so as to be hollow.

5. A device according to claim 4, wherein one of said upright legs accommodates a circuit board containing said components, and said light receiver.

6. A device according to claim 5, wherein said light transmitter is housed in the other upright leg.

7. A device according to claim 4, wherein both said light transmitter and said light receiver are housed in the same leg and that a reflector is placed in the opposite leg.

8. A device according to claim 4, wherein the upper end region of one or both legs is shaped with a bevel edge.

9. A device according to claim 1, wherein there is arranged a cover in the bottom of said holder, detachably fastened to said holder, by snap fastening to the bottom edge portions of said holder, and which together with said holder forms a compartment for wires, and where there may also be arranged drainage holes in the bottom of the letterbox.

10. A device according to claim 1, wherein the transverse portion of the holder is made so as to be telescopic.

11. A device or unit according to claim 1, wherein the transmitter component of the detector is an IR diode and the receiver component is an IR phototransistor.

12. A detector-transmitter unit for use in a device for detecting and signalling or indicating status as regards contents in a container, and in particular a letterbox, comprising a detector for registering a change of state in said letterbox, which registration is transmitted to and activates a remote display in order to produce on said display a visual and/or audible message which signals that contents have been deposited in said letterbox, which detector comprises a light emitting diode and a photodiode, or optionally an electronic sensor (inductive/capacitive), an ultrasonic sensor, a mechanical or electromagnetic switch means etc., wherein there is provided an oscillator, a timer to control the timing and a power source, an amplifier, a multivibrator or flip-flop having a first input and a second input and a code circuit having address code inputs and a high-frequency transmitter module, wherein said timer activates and pulses said detector-transmitter component for about 20 milliseconds with a period of about 40 seconds, and if said letterbox or container is empty, a detector-receiver component receives pulses from said transmitter component and the response thereto is relayed in the form of electrical signals to said amplifier; and if contents are introduced into said letterbox, the connection between said transmitter component and said receiver component is broken with the result that said amplifier is without a signal, and wherein the output from the amplifier is connected to said second input on the multivibrator whose first input is connected to said timer causes said multivibrator to be synchronized at the end of the activation time of said transmitter component, and the logical state of said flip-flop thus becomes a signal which indicates whether there are contents in said letterbox or not, the activation time and the period being implemented by a circuit with the oscillator at fixed frequency and counter elements which, depending on the number of elements and their connection, indicate the time intervals, and where the voltage from said oscillator is used to operate the power source of said transmitter component, and the information from said flip-flop is passed to said code circuit which codes this information together with an address signal in the form of a serial telegram that controls said high-frequency transmitter which transmits the address and data or information telegram immediately after the activation time for said transmitter component when the contents of said letterbox has been detected.

13. A device or unit according to claim 12, wherein the transmitter component of the detector is an IR diode and the receiver component is an IR phototransistor.

14. A receiver-display unit for use in a device for detecting and signalling or indicating status as regards contents in a container, and in particular a letterbox, comprising a detector for registering a change of state in said letterbox, which registration is transmitted to and activates a remote display in order to produce on said display a visual and/or audible message which signals that contents have been deposited in said letterbox, which detector comprises a light-emitting diode and a photodiode, or optionally an electronic sensor (inductive/capacitive), and ultrasonic sensor, a mechanical or electromagnetic switch means etc., wherein said receiver-display unit comprises a high-frequency receiver, a decoder, a monostable multivibrator or flip-flop and a display, where said display comprises a visual and/or audible signal means, and where said telegram on reaching said receiver is passed to said decoder that ascertains whether said telegram contains a valid receiver address and determines the logical state of the data or information; if the information indicates that there are contents in said letterbox, an appropriate signalling means on said display is activated.

15. A unit as disclosed in claim 14, wherein the signalling means is a light diode that lights up for about 100 milliseconds with a period of about 2 seconds, so that the power supply for said receiver and display unit can be provided by a battery as there is only power consumption of any significance when said diode lights up.

16. A unit disclosed in claim 14, wherein said high-frequency receiver is controlled by said monostable multi-vibrator or flip-flop which is triggered by said decoder circuit, and there is used a logic which means that if said transmitter sends a telegram in the period and if said monostable flip-flop on the receiver side activates said high-frequency receiver a few seconds before the period of the transmitter side begins, said receiver will always be active when the next telegram arrives and said receiver will be inactive the rest of the time and thus consumes no power, so that the useful life of said battery is prolonged considerably, the synchronization of the period in the transmitter and said monostable flip-flop being implemented by said flip-flop being triggered by a valid telegram.

17. A device or unit according to claim 14, wherein the transmitter component of the detector is an IR diode and the receiver component is an IR phototransistor.

* * * * *